US012203459B2

(12) United States Patent
Peterson et al.

(10) Patent No.: US 12,203,459 B2
(45) Date of Patent: Jan. 21, 2025

(54) CONTROL OF A DUAL-PUMP SINGLE-POWER SOURCE SYSTEM

(71) Applicant: Caterpillar Inc., Peoria, IL (US)

(72) Inventors: Lucas J. Peterson, Washington, IL (US); David Alexandru Voiculescu, Tomball, TX (US); Andy Publes, Katy, TX (US); Mark Francis Grimes, Cypress, TX (US)

(73) Assignee: Caterpillar Inc., Peoria, IL (US)

( * ) Notice: Subject to any disclaimer, the term of this patent is extended or adjusted under 35 U.S.C. 154(b) by 262 days.

(21) Appl. No.: 17/813,575

(22) Filed: Jul. 19, 2022

(65) Prior Publication Data

US 2024/0026875 A1 Jan. 25, 2024

(51) Int. Cl.

| | |
|---|---|
| ***F04B 23/06*** | (2006.01) |
| ***E21B 43/26*** | (2006.01) |
| ***F04B 9/02*** | (2006.01) |
| ***F04B 49/06*** | (2006.01) |
| ***F04B 49/08*** | (2006.01) |

(52) U.S. Cl.

CPC ..... *F04B 23/06* (2013.01); *F04B 9/02* (2013.01); *F04B 49/065* (2013.01); *F04B 49/08* (2013.01); *E21B 43/26* (2013.01); *F04B 2201/1202* (2013.01); *F04B 2201/1208* (2013.01); *F04B 2201/124* (2013.01); *F04B 2205/05* (2013.01)

(58) Field of Classification Search

CPC ..... F04B 9/02; F04B 23/06; F04B 49/065; F04B 49/08; F04B 2201/1202; F04B 2201/1208; F04B 2201/124; F04B 2205/05; E21B 43/26

USPC ..... 417/215, 216, 223, 364, 429

See application file for complete search history.

(56) References Cited

U.S. PATENT DOCUMENTS 5,848,877 A * 12/1998 Dill ..... F04B 49/065 417/15
6,578,634 B2 * 6/2003 Newman ..... E21B 47/008 166/275
7,022,044 B2 * 4/2006 Legner ..... E02F 9/2253 477/68

(Continued)

FOREIGN PATENT DOCUMENTS

CA 2639418 A1 * 3/2009 ..... F04B 17/05
CA 3123286 A1 * 1/2022 ..... E21B 43/2605

(Continued)

*Primary Examiner* — Alexander B Comley

(57) ABSTRACT

In some implementations, a controller may obtain an indication of a first crank angle associated with a first pump, of a dual-pump single-power source system, that is mechanically connected to a power source of the dual-pump single-power source system via a first clutch. The controller may obtain an indication of a second crank angle associated with a second pump, of the dual-pump single-power source system, that is mechanically connected to the power source via a second clutch. The controller may determine that a difference between the first crank angle and the second crank angle is outside of a tolerance of a crank angle difference value. The controller may modulate a fluid pressure associated with at least one of the first clutch or the second clutch to cause the difference between the first crank angle and the second crank angle to be within the tolerance of the crank angle difference value.

20 Claims, 4 Drawing Sheets

(56) References Cited

U.S. PATENT DOCUMENTS

| | | | | |
|---|---|---|---|---|
| 8,506,267 | B2 | 8/2013 | Gambier et al. | |
| 10,378,326 | B2 | 8/2019 | Morris et al. | |
| 10,753,165 | B1 * | 8/2020 | Fischer | H02P 27/04 |
| 10,815,764 | B1 * | 10/2020 | Yeung | F04B 49/007 |
| 2006/0245934 | A1 * | 11/2006 | Deivasigamani | F04D 13/021 417/212 |
| 2008/0173033 | A1 * | 7/2008 | Colavincenzo | F04B 49/065 62/133 |
| 2009/0068031 | A1 * | 3/2009 | Gambier | F04B 17/06 417/364 |
| 2009/0092510 | A1 * | 4/2009 | Williams | F04B 1/00 417/521 |
| 2010/0300683 | A1 * | 12/2010 | Looper | E21B 47/008 166/250.01 |
| 2016/0369609 | A1 * | 12/2016 | Morris | F16D 48/062 |
| 2017/0284484 | A1 * | 10/2017 | Bickmann, III | B08B 3/02 |
| 2017/0335842 | A1 * | 11/2017 | Robinson | F16F 15/145 |
| 2017/0370524 | A1 * | 12/2017 | Wagner | F04B 23/02 |
| 2020/0040878 | A1 * | 2/2020 | Morris | F04B 23/06 |
| 2021/0025383 | A1 * | 1/2021 | Bodishbaugh | G06N 20/00 |
| 2021/0040830 | A1 * | 2/2021 | Mu | F04B 23/04 |
| 2022/0034211 | A1 * | 2/2022 | Morris | F04B 23/04 |
| 2022/0381125 | A1 * | 12/2022 | Wilson | F04D 13/12 |

FOREIGN PATENT DOCUMENTS

| | | | | | |
|---|---|---|---|---|---|
| CN | 107237617 | A | * | 10/2017 | |
| CN | 207194878 | U | * | 4/2018 | |
| CN | 109578459 | A | * | 4/2019 | F16D 25/062 |
| CN | 112983381 | A | * | 6/2021 | E21B 43/26 |
| WO | WO-2018044307 | A1 | * | 3/2018 | F04B 15/02 |

* cited by examiner

CONTROL OF A DUAL-PUMP SINGLE-POWER SOURCE SYSTEM

TECHNICAL FIELD

The present disclosure relates generally to hydraulic fracturing systems and, for example, to control of a dual-pump single-power source system.

BACKGROUND

Hydraulic fracturing is a well stimulation technique that typically involves pumping hydraulic fracturing fluid into a wellbore (e.g., using one or more well stimulation pumps) at a rate and a pressure (e.g., up to 15,000 pounds per square inch) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

A hydraulic fracturing system may include one or more power sources for providing power to components (e.g., the pumps) of the hydraulic fracturing system. In some cases, a single power source (e.g., a single power source) may power or drive multiple pumps. For example, a single power source may power or drive two pumps of a hydraulic fracturing system. This may improve a flow capacity and/or efficiency of the hydraulic fracturing system because a single power source may drive multiple pumps of the hydraulic fracturing system. However, if the dual-pump single-power source system develops a problem (e.g., with a coupling between the power source and a pump, with a drive shaft of one of the pumps, and/or with a leak in one of the pumps, among other examples), the power source may be shut down to enable the problem to be addressed. In some cases, the problem may be with only a single pump of the system. However, because the single power source powers or drives multiple pumps, shutting down the power source to address the problem with a single pump may result in other pumps (e.g., that are currently operational or not experiencing problems) to also be shut down while the problem is being addressed. In other words, if an operator wants to stop one pump of a dual-pump single-power source system (e.g., for any reason), both pumps need to be stopped. This results in increased downtime for a larger flow capacity (e.g., due to the use of a dual-pump single-power source system, multiple pumps may be shut down when a problem occurs rather than only shutting down the pump associated with the problem). As a result, a pump that may otherwise be capable of running may have an increased downtime due to problems with another pump of the dual-pump single-power source system.

The dual-pump single-power source system of the present disclosure solves one or more of the problems set forth above and/or other problems in the art.

SUMMARY

In some implementations, a method of controlling a dual-pump single-power source system includes obtaining, by a controller, an indication of a first crank angle associated with a first pump of the dual-pump single-power source system, wherein the first pump is mechanically connected to a power source of the dual-pump single-power source system via a first clutch; obtaining, by the controller, an indication of a second crank angle associated with a second pump of the dual-pump single-power source system, wherein the second pump is mechanically connected to the power source via a second clutch; determining, by the controller, that a difference between the first crank angle and the second crank angle is outside of a tolerance of a crank angle difference value; and modulating, by the controller, a fluid pressure associated with at least one of the first clutch or the second clutch to cause the difference between the first crank angle and the second crank angle to be within the tolerance of the crank angle difference value.

In some implementations, a controller for controlling a dual-pump single-power source system includes one or more memories, and one or more processors configured to: obtain an indication of a first crank angle associated with a first pump of the dual-pump single-power source system, wherein the first pump is mechanically connected to a power source of the dual-pump single-power source system via a first clutch; obtain an indication of a second crank angle associated with a second pump of the dual-pump single-power source system, wherein the second pump is mechanically connected to the power source via a second clutch; and perform an action to cause the first clutch to modulate between engaging and disengaging a mechanical connection with the power source to cause the first crank angle to be modified to a modified crank angle, wherein the first crank angle is modified such that a difference between the modified crank angle and the second crank angle is within a tolerance of a crank angle difference value.

In some implementations, a dual-pump single-power source system includes a power source; a first pump connected to the power source via a first mechanical connection that includes a first clutch; a second pump connected to the power source via a second mechanical connection that includes a second clutch; and a controller configured to: obtain an indication of a first crank angle associated with the first pump; obtain an indication of a second crank angle associated with the second pump; determine that a difference between the first crank angle and the second crank angle is outside of a tolerance of a crank angle difference value; and perform an action to cause the first clutch to modulate between engaging and disengaging the first mechanical connection while the power source is running to cause the first crank angle to be modified to a modified crank angle, wherein a difference between the modified crank angle and the second crank angle is within the tolerance of the crank angle difference value.

DETAILED DESCRIPTION

Figure 1:
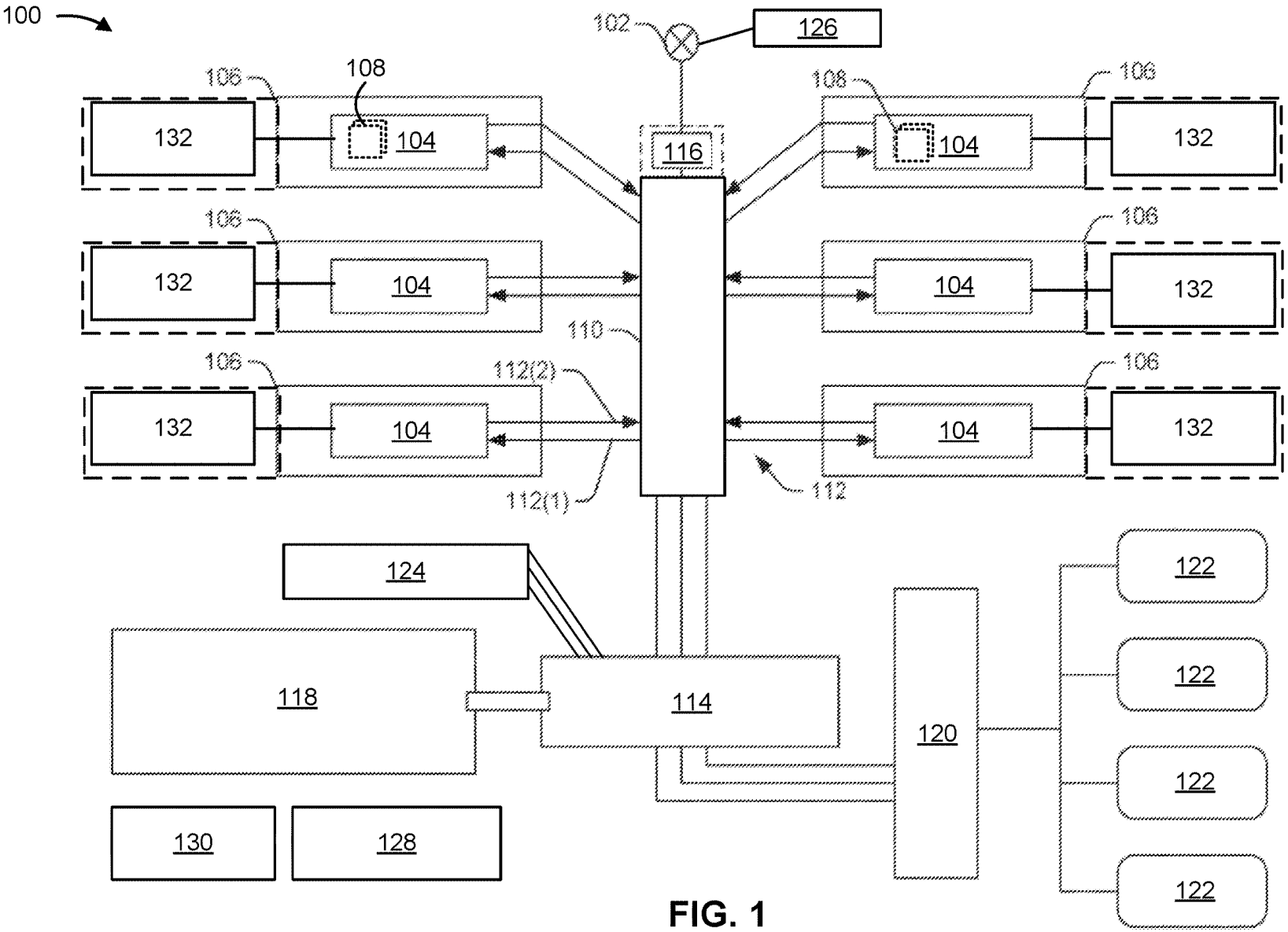
FIG. 1 is a diagram illustrating an example hydraulic fracturing system described herein.

FIG. 1 is a diagram illustrating an example hydraulic fracturing system 100 described herein. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process. Although examples may be described here in connection with a hydraulic fracturing system, the dual-pump single-power source system of the present disclosure may be used in any fluid pumping application.

The hydraulic fracturing system 100 includes a well 102. As described previously, hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may be positive displacement pumps or plunger pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, and/or the pressure necessary to complete the hydraulic fracture, among other examples. The hydraulic fracturing system 100 may include any number of hydraulic fracturing trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells 102. The fluid pumps 108, the fluid conduits 112, the manifold 110, and/or the fracturing head 116 may define a fluid system of the hydraulic fracturing system 100.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other type of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, and/or gates, among other examples.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 is in communication (e.g., by a wired connection or a wireless connection) with the pump systems 104 of the trailers 106. The controller 130 may also be in communication with other equipment and/or systems of the hydraulic fracturing system 100. The controller 130 may include one or more memories, one or more processors, and/or one or more communication components. The controller 130 (e.g., the one or more processors) may be configured to perform operations associated with controlling a dual-pump single-power source system 200, as described in connection with FIGS. 2-4.

Figure 2:
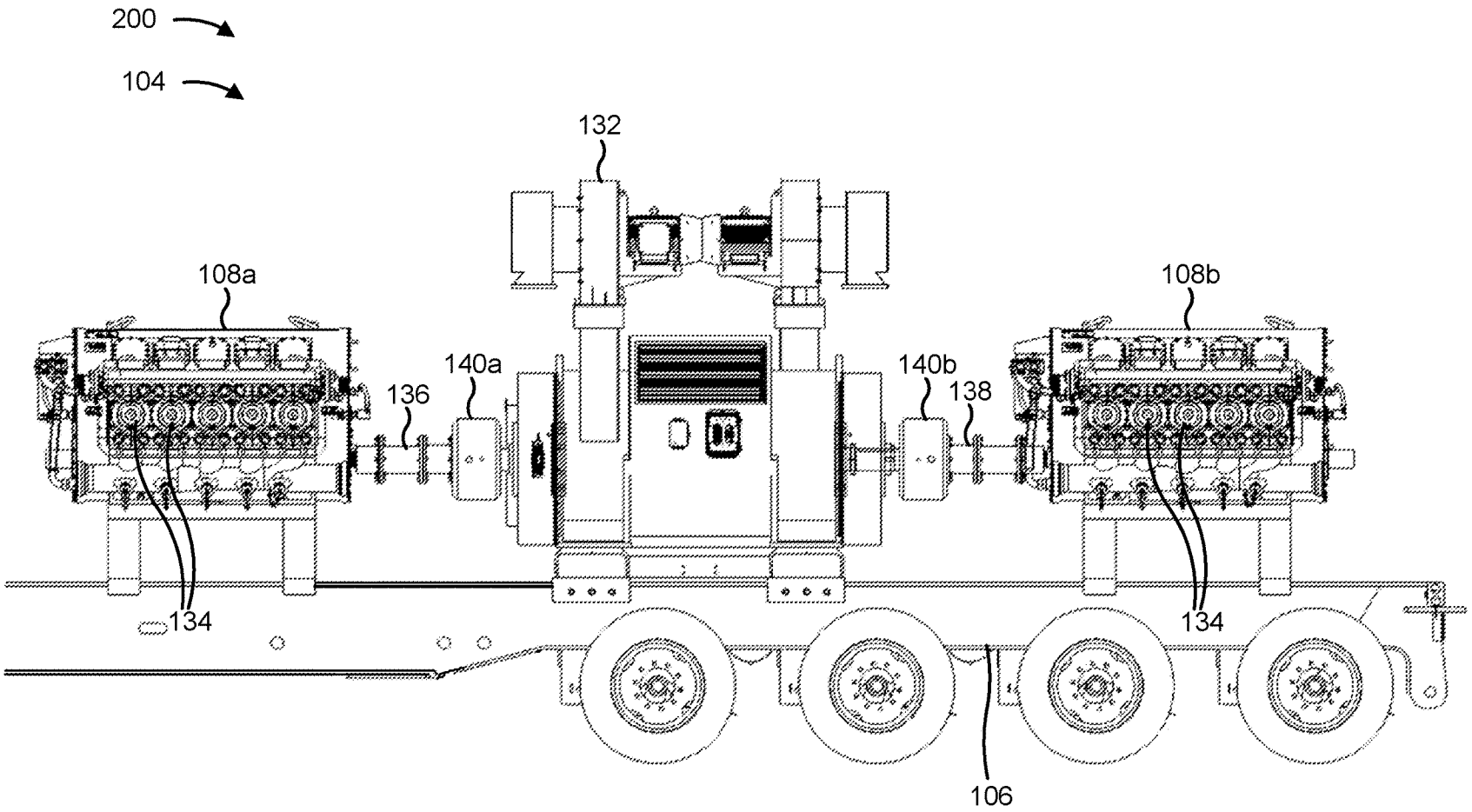
FIG. 2 is a diagram illustrating an example dual-pump single-power source system described herein.

The hydraulic fracturing system 100 may include one or more power sources, such as one or more power sources 132. The one or more power sources 132 may be included on one or more hydraulic fracturing trailers 106 (e.g., as shown by the dashed lines in FIG. 1). Alternatively, a power source 132 may be separate from the hydraulic fracturing trailers 106. In some examples, each pump system 104 may include a power source 132. In some cases, a pump system 104 may include a dual-pump single-power source system 200 (e.g., depicted in FIG. 2). For example, as depicted in FIG. 2, a hydraulic fracturing trailer 106 may include a power source 132 that powers or drives multiple fluid pumps 108 (e.g., two or more fluid pumps 108). Although examples are described herein associated with a dual-pump system (e.g., two fluid pumps 108), a pump system 104 may include more than two fluid pumps 108 powered by a single power source 132 in a similar manner as described herein. The power sources 132 may be in communication with the controller 130 (e.g., wired communication or wireless communication). The power sources 132 may power the pump systems 104 and/or the fluid pumps 108.

As indicated above, FIG. 1 is provided as an example. Other examples may differ from what is described with regard to FIG. 1.

FIG. 2 is a diagram illustrating an example dual-pump single-power source system 200 described herein. The dual-pump single-power source system 200 may include one or more components of the hydraulic fracturing system 100, as described herein. The dual-pump single-power source system 200 may be associated with, or included in, a pump system 104.

For example, as shown in FIG. 2, the dual-pump single-power source system 200 may include a hydraulic fracturing trailer 106. The hydraulic fracturing trailer 106 may include a power source 132 mounted on the hydraulic fracturing trailer 106. The power source 132 may power or drive multiple fluid pumps 108 (e.g., two as shown in FIG. 2), as described herein. A power source 132 may include an electric motor, a motor with gearbox, a turbine, a turbine with gearbox, multiple motors or turbines on a combination gearbox, an engine, and/or another rotational power source (e.g., a power source that causes an output drive shaft to rotate), among other examples. The power source 132 may include a power source controller, such as a variable frequency drive (VFD), that is configured to control an output speed (e.g., a rotational speed of an output shaft of the power source 132) by varying a frequency and/or voltage of a power supply to the power source 132. In some other cases, a different type of power source may be included in the dual-pump single-power source system 200 (e.g., rather than a power source 132), such as a turbine (e.g., a gas turbine), or an engine (e.g., a reciprocating engine), among other examples. In some cases, an appropriate gear reduction may be included between power source and pump, such as a multi-speed transmission or a gearbox.

The hydraulic fracturing trailer 106 may include multiple fluid pumps 108 (e.g., a first fluid pump 108*a* and a second fluid pump 108*b*) mounted on the hydraulic fracturing trailer 106. The dual-pump single-power source system 200 may include at least one fluid conduit 112, as described herein (e.g., not shown in FIG. 2). The fluid conduit(s) 112 may be in fluid communication with the fluid pumps 108. For example, the fluid conduit(s) 112 may fluidly connect a fluid pump 108 and the manifold 110, the manifold 110 and the well 102 (e.g., via the fracturing head 116), or the like. In other words, the fluid conduit(s) 112 may fluidly connect components of the hydraulic fracturing system 100 that are downstream of a fluid pump 108.

Each of the multiple fluid pumps 108 may be powered or driven by the power source 132. In some examples, a fluid pump 108 may include a quantity of cylinders 134. For example, a fluid pump 108 may be a reciprocating pump that use a plunger or piston to move fluid through a cylindrical chamber (e.g., a cylinder 134). The fluid pump 108 may use a crank mechanism to create a reciprocating motion along an axis, which builds pressure in a cylinder 134 to force fluid through the fluid pump 108. The pressure in a chamber of the fluid pump 108 actuates valves at both the suction and discharge points of the fluid pump 108. The overall capacity of the fluid pumps 108 may be calculated with the area of the piston or plunger, a stroke length, a quantity of pistons or plungers (e.g., a quantity of cylinders 134), and a speed of a drive of the fluid pump 108. In other words, the overall capacity of the fluid pumps 108 may be proportional to the quantity of cylinders 134 included in each fluid pump 108. In some cases, as shown in FIG. 2, the fluid pumps 108 may include five cylinders 134. In other examples, the fluid pumps 108 may include a different quantity of cylinders 134, such as three cylinders 134, or more than five cylinders 134.

As shown in FIG. 2, the power source 132 may be associated with a first mechanical connection 136 to the first fluid pump 108*a* and a second mechanical connection 138 to the second fluid pump 108*b*. For example, the power source 132 may include multiple output drive shafts or multiple drivetrains. For example, the first mechanical connection 136 may include a coupling between an output drive shaft of the power source 132 to an input drive shaft of the first fluid pump 108*a*. Similarly, the second mechanical connection 138 may include a coupling between an output drive shaft of the power source 132 to an input drive shaft of the second fluid pump 108*b*.

As shown in FIG. 2, the mechanical connections (e.g., the first mechanical connection 136 and the second mechanical connection 138) may include a clutch 140 or other component that is configured to engage and/or disengage the mechanical connections. For example, the first mechanical connection 136 may include a first clutch 140*a* and the second mechanical connection 138 may include a second clutch 140*b*. A clutch 140 may enable engagement and disengagement of a coupling of an output drive shaft of the power source 132 to another drive shaft, such as an input drive shaft of a fluid pump 108. The clutch 140 may be a mechanical component (e.g., a mechanical clutch) to engage and disengage a coupling of the output drive shaft of the power source 132 with another drive shaft. The clutch 140 may be a hydraulic clutch that is configured to operate via pressurized hydraulic fluid. For example, the controller 130 may control a supply of hydraulic fluid to a clutch 140 to cause the clutch 140 to engage or disengage a mechanical connection (e.g., the first mechanical connection 136 or the second mechanical connection 138). In some examples, the clutch 140 may include a pressure clutch (e.g., that is configured to engage a mechanical connection via an increase in a pressure of the hydraulic fluid) or a pressure release clutch, such as a spring applied pressure release clutch (e.g., that is configured to disengage a mechanical connection via an increase in a pressure of the hydraulic fluid).

For example, the clutch 140 may be in-line with the mechanical connection (e.g., the first mechanical connection 136 or the second mechanical connection 138). The clutch 140 may be a shaft-mounted clutch (e.g., the clutch 140 may be mounted on a drive shaft or coupled directly to a drive shaft). In some examples, the clutch 140 may be a shaft-mounted hydraulically actuated clutch. The clutch 140 may be mounted to the power source 132 shaft, or the pump shaft 108. In some examples, the clutch 140 may be independently supported (e.g., independently from another component of the dual-pump single-power source system 200). As shown in FIG. 2, the clutch 140 may be coupled to an output shaft of the power source 132 and an input shaft of a fluid pump 108. A pressure of hydraulic fluid may be varied to cause components of the clutch 140 to engage a mechanical connection (e.g., the first mechanical connection 136 or the second mechanical connection 138) and/or to disengage a mechanical connection (e.g., the first mechanical connection 136 or the second mechanical connection 138).

As a result, a single fluid pump 108 (e.g., the first fluid pump 108*a* or the second fluid pump 108*b*) of the dual-pump single-power source system 200 may be taken offline (e.g., may be shut down) while the power source 132 is running by disengaging a mechanical connection (e.g., the first mechanical connection 136 or the second mechanical connection 138) between the single fluid pump 108 and the power source 132. Therefore, the power source 132 may still power or drive other fluid pumps 108 of the dual-pump single-power source system 200 while the single fluid pump 108 is shut down (e.g., for repairs or to address a problem associated with the fluid pump 108 or with a coupling to the power source 132). For example, the first clutch 140*a* may cause the first mechanical connection 136 to be disengaged. Therefore, the first fluid pump 108*a* may be shut down. At the same time, the power source 132 may remain running to power or drive the second fluid pump 108*b* (e.g., the second clutch 140*b* may cause the second mechanical connection 138 to be engaged). As a result, any fluid pump 108 of the dual-pump single-power source system 200 may be shut down "on-the-fly" without affecting an operation or performance of other fluid pumps of the dual-pump single-power source system 200. This may improve an efficiency and/or a flow capacity of the dual-pump single-power source system 200. Additionally, this may reduce a downtime associated with the dual-pump single-power source system 200.

As indicated above, FIG. 2 is provided as an example. Other examples may differ from what is described with regard to FIG. 2.

Figure 3:
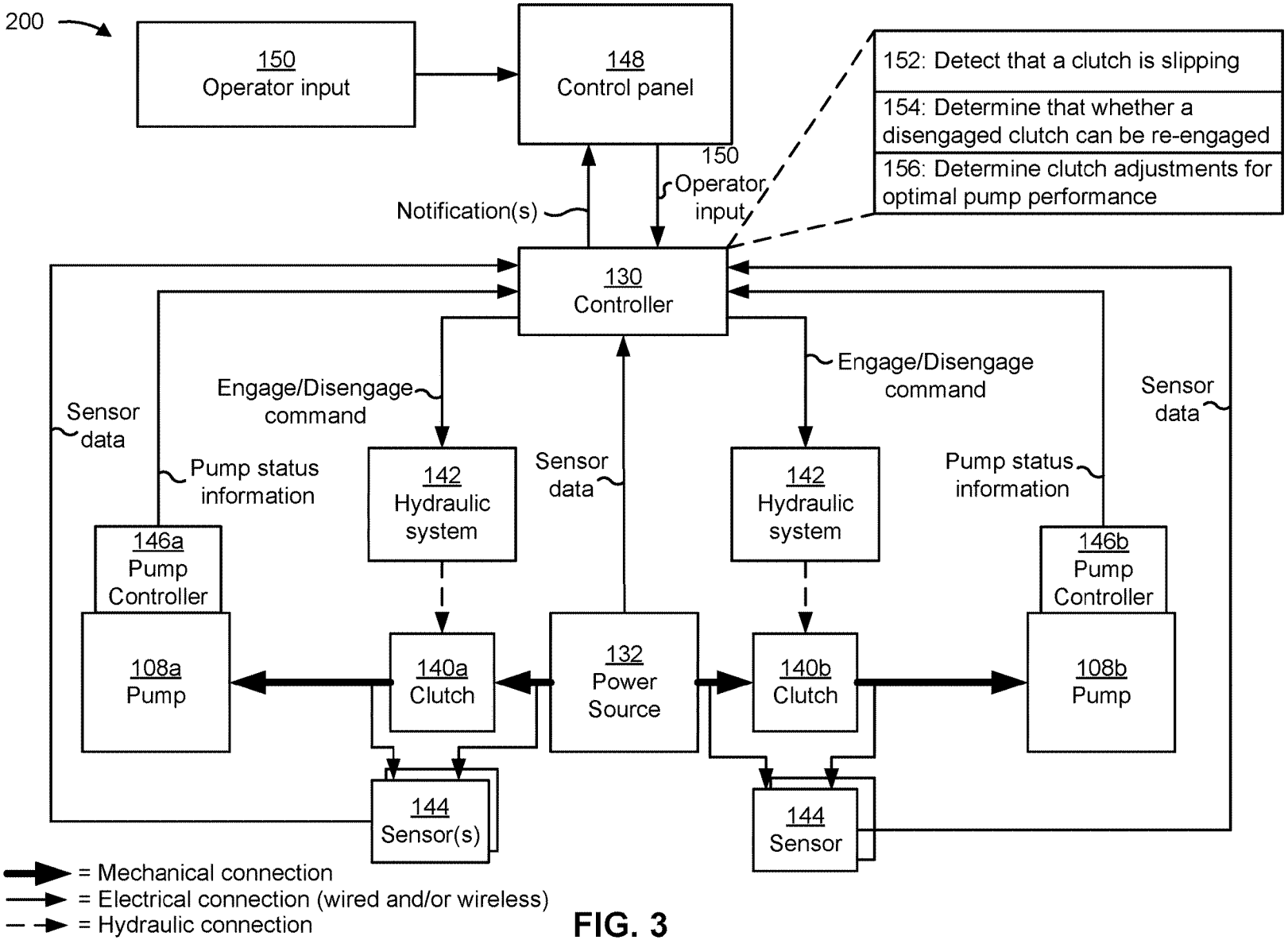
FIG. 3 is a diagram illustrating an example of controlling the dual-pump single-power source system described herein.

FIG. 3 is a diagram illustrating an example of controlling the dual-pump single-power source system 200 described herein. The controller 130 may control various operations and/or functions associated with the dual-pump single-power source system 200.

As shown in FIG. 3, components of the dual-pump single-power source system 200 may be connected via mechanical connections, electrical connections, and/or hydraulic connections. The electrical connections may include wired connections and/or wireless connections that enable signals or information to be communicated between two or more components. For example, the electrical connections may be associated with a wireless wide area network (e.g., a cellular network or a public land mobile network), a local area network (e.g., a wired local area network or a wireless local area network (WLAN), such as a Wi-Fi network), a personal area network (e.g., a Bluetooth network), a near-field communication network, a private network, the Internet, and/or a combination of these or other types of networks. The electrical connections may enable communication among the components of the dual-pump single-power source system 200. The hydraulic connections may include one or more fluid lines or hydraulic circuits configured to provide or relieve hydraulic fluid to a component.

For example, the controller 130 may provide instructions (e.g., an engage command and/or a disengage command) that cause a hydraulic system 142 (e.g., one or more hydraulic circuits) to provide hydraulic fluid to, or to modify a pressure of hydraulic fluid being provided to, a clutch 140. This may cause the clutch 140 to change between a disengaged position (e.g., disengaging a mechanical connection) and an engaged position (e.g., engaging a mechanical connection). For example, to shut down the first fluid pump 108*a*, the controller 130 may provide instructions to the hydraulic system 142 to cause the hydraulic system 142 to modify a flow of hydraulic fluid to the first clutch 140*a* (e.g., a disengage command) to cause the first clutch 140*a* to disengage the first mechanical connection 136 between the first fluid pump 108*a* and the power source 132 (e.g., while the power source 132 is running and is mechanically connected to the second fluid pump 108*b* via the second clutch 140*b* being in an engaged position).

The power source 132 may include one or more sensors. For example, the power source 132 may include one or more speed sensors. The one or more speed sensors may measure a rotational speed of an output drive shaft of the power source 132. For example, the one or more speed sensors may be rotational speed sensors. As shown in FIG. 3, the power source 132 (or a controller of the power source 132) may provide sensor data associated with the power source 132 to the controller 130. The sensor data may include a rotational speed of one or more output drive shafts of the power source 132. As another example, the sensor data may include an indication of a voltage or frequency of an input power supply to the power source 132 (e.g., via a VFD), which may enable the controller 130 to determine an output speed and/or torque associated with the power source 132.

Each clutch 140 may be associated with one or more sensors 144. For example, a first sensor 144 may be associated with an input to a clutch 140. A second sensor 144 may be associated with an output of a clutch 140. For example, the first sensor 144 may measure a rotational speed of an input to the clutch 140 or a crank angle or phase position of an input shaft associated with the clutch 140. The second sensor 144 may measure a rotational speed of an output of the clutch 140 or a crank angle or phase position of an output shaft associated with the clutch 140. As shown in FIG. 3, the sensor(s) 144 may provide sensor data associated with the clutches 140 (e.g., the first clutch 140*a* and the second clutch 140*b*) of the dual-pump single-power source system 200 to the controller 130. For example, the sensor(s) 144 may provide an indication of an input speed associated with a given clutch 140 and an indication of an output speed associated with the given clutch 140. The sensor data may include an identifier of the clutch 140 that is associated with the sensor data (e.g., to enable the controller 130 to identify the correct clutch 140 that is associated with the sensor data). In some examples, timing marks may be used in place of, or in addition to, speed sensors on both input and output of clutches 140. These marks may be used to determine phase angle across each clutch.

A fluid pump 108 may include a pump controller 146. For example, the first fluid pump 108*a* may include a first pump controller 146*a* and the second fluid pump 108*b* may include a second pump controller 146*b*. A pump controller 146 may control one or more operations associated with a fluid pump 108. Additionally, or alternatively, the pump controller 146 may monitor operations associated with a fluid pump 108 and/or perform one or more measurements associated with the fluid pump. For example, a pump controller 146 may obtain measurements (e.g., from one or more sensors associated with the fluid pump 108) of a speed (e.g., a rotational speed) of an input drive shaft of the fluid pump 108. As another example, the pump controller 146 may obtain measurements associated with a pressure (e.g., a discharge pressure) of the fluid pump 108. As another example, the pump controller 146 may obtain measurements associated with a crank angle of the fluid pump 108. The crank angle may be an angle of rotation of a crankshaft measured from a reference position or direction, such as a position in which a piston or plunger is at a highest point (e.g., which may be referred to as top dead center (TDC)).

As shown in FIG. 3, a pump controller 146 (e.g., the first pump controller 146*a* and/or the second pump controller 146*b*) may provide pump status information to the controller 130. The pump status information may include one or more measurements associated with a given fluid pump 108, such as a speed (e.g., a rotational speed) of an input drive shaft of the fluid pump 108, a discharge pressure of the fluid pump 108, and/or a crank angle of the fluid pump 108, among other examples. The pump status information may include an identifier of the fluid pump 108 that is associated with the pump status information (e.g., to enable the controller 130 to identify the correct fluid pump 108 associated with the pump status information). The pump status information may include other information associated with a given fluid pump 108, such as oil temperature, failure mode information, and/or an operation status, among other examples.

The controller 130 may provide information or instructions to a control panel 148. The control panel 148 may include one or more operator input options (e.g., buttons, switches, user interfaces, among other examples), one or more display screens, one or more optical indicators (e.g., light emitting diodes), and/or one or more audio outputs (e.g., speakers), among other examples. For example, the control panel 148 may enable an operator to view information associated with the dual-pump single-power source system 200 and to provide operator inputs 150 to cause operation or actions associated with the dual-pump single-power source system 200 to be performed. The control panel 148 may be associated with, or included in, the data monitoring system 128.

The introduction of the clutches 140 to the dual-pump single-power source system 200 may introduce several problems. For example, a clutch 140 may experience slippage, resulting in a failure of the clutch 140 and/or a coupling between the power source 132 and a fluid pump 108. As used herein, "slippage" may refer to a condition in mechanical components (e.g., a disc or flywheel, among other examples) of the clutch 140 that cause the mechanical connections between drive shafts to not function properly (e.g., such as when a mechanical connection between two components of the clutch 140 is failing, causing power flow between an input to the clutch 140 and an output of the clutch 140 to be interrupted). For example, when a clutch 140 experiences slippage, an input speed to the clutch 140 (e.g., a rotation speed of an input to the clutch 140) may be different than an output speed of the clutch 140 (e.g., a rotation speed of an output of the clutch 140). This may result in an increase in a speed of the power source 132 without a corresponding increase to the input of a fluid pump 108. As another example, when a clutch 140 is in a disengaged position, the power source 132 may remain running. If an operator intends to re-engage the clutch 140 (e.g., to power on a fluid pump 108 associated with the clutch 140), the clutch 140 may be moved to an engaged position. However, depending on a current speed of the power source 132, this may place high levels of stress and/or torque on components of the power source 132, the clutch 140, and/or the fluid pump 108, and/or to increase a temperature associated with the clutch 140 (e.g., due to frictional forces between components), which may cause these components to fail.

The controller 130 may perform one or more operations or actions to address and/or mitigate the problems described above. For example, as shown by reference number 152, the controller 130 may determine or detect that a clutch 140 is slipping (e.g., is experiencing slippage). For example, the controller 130 may obtain a set of measurement values associated with the dual-pump single-power source system 200. The set of measurement values may include one or more speed measurements associated with a clutch 140 (e.g., the first clutch 140*a* and/or the second clutch 140*b*) that is coupled to the power source 132 and a fluid pump 108, a measurement value indicating an output speed of the power source 132 (e.g., a speed measurement or an indication from a VFD of the power source 132), or a first crank angle associated with the first fluid pump 108*a* and/or a second crank angle associated with the second fluid pump 108*b*, among other examples. The controller 130 may obtain the set of measurement values in a similar manner as described above (e.g., from the power source 132, a controller of the power source 132, a sensor 144, and/or a pump controller 146, among other examples). For example, the one or more speed measurements associated with the clutch 140 may include a first speed measurement associated with an input speed of the clutch and a second speed measurement associated with an output speed of the clutch.

The controller 130 may detect that the clutch 140 is experiencing slippage based on comparing at least two measurement values of the set of measurement values. For example, the controller 130 may determine a difference (e.g., a delta value) between the output speed of the power source 132, the input speed of the clutch 140, and/or the output speed of the clutch 140. The controller 130 may detect that the clutch 140 is experiencing slippage based on the difference satisfying a slippage threshold. For example, the controller 130 may detect that the clutch 140 is experiencing slippage based on detecting a difference between at least two of the output speed of the power source 132, the input speed of the clutch 140, and/or the output speed of the clutch 140. If the difference (e.g., in units of revolutions per minute (RPMs)) satisfies the slippage threshold, then the controller 130 may detect that the clutch 140 is experiencing slippage (e.g., because there is a power loss somewhere between the power source 132 and an output of the clutch 140, indicating that the clutch 140 is slipping).

As another example, the controller 130 may determine a difference between the first crank angle (e.g., associated with the first fluid pump 108*a*) and the second crank angle (e.g., associated with the second fluid pump 108*b*). The controller 130 may determine that a clutch 140 is experiencing slippage based on the difference satisfying a crank angle threshold. In some examples, the controller 130 may determine a first difference between the first crank angle (e.g., associated with the first fluid pump 108*a*) and the second crank angle (e.g., associated with the second fluid pump 108*b*) at a first time. The controller 130 may determine a second difference between the first crank angle (e.g., associated with the first fluid pump 108*a*) and the second crank angle (e.g., associated with the second fluid pump 108*b*) at a second time. If a variation between the first difference and the second difference satisfies the crank angle threshold, then the controller 130 may determine that a clutch 140 is experiencing slippage (e.g., because a difference in crank angles between the two fluid pumps should remain relatively constant over time. The crank angles may remain constant when clutches 140 are not slipping and drivelines are properly transmitting power).

As another example, the controller 130 may monitor a first phase associated with an output of the power source 132, a second phase associated with an input of the clutch 140, and a third phase associated with an output of the clutch 140. "Phase" may refer to a relative rotational position of a rotating shaft. If the clutch 140 is operating properly, the phases between the output of the power source 132, the input of the clutch 140, and the output of the clutch 140 should remain relatively constant over time. If there is a phase shift between the phases of the output of the power source 132, the input of the clutch 140, and/or the output of the clutch 140 over time, then the controller 130 may detect that the clutch 140 is slipping. For example, the controller 130 may obtain indications of the various phases each revolution (or every X revolutions) associated with the shafts at an output of the power source 132, the input of the clutch 140, and the output of the clutch 140. The controller 130 may determine whether a phase shift between at least two of the phases satisfies a phase shift threshold. If the phase shift between at least two of the phases satisfies the phase shift threshold, then the controller 130 may determine that the clutch 140 is slipping. The phase shifts may provide an earlier indication of slippage because a deviation of phases at the various points may occur before a variation in rotational speed at the various points. Therefore, using the phase shifts to detect slippage of the clutch may enable the controller 130 to detect earlier in time that a clutch 140 is slipping.

Based on detecting that the clutch 140 is slipping, the controller 130 may perform an action to cause the clutch 140 to disengage a mechanical connection (e.g., the first mechanical connection 136 or the second mechanical connection 138) between a fluid pump 108 and the power source 132 (e.g., while the power source 132 is running). For example, the controller 130 may cause a control panel indication (e.g., to the control panel 148) to cause a notification that the clutch 140 is experiencing slippage to be displayed via the control panel 148. Based on displaying or outputting the notification, the operator input 150 may indicate that the clutch 140 is to be disengaged. The controller 130 may obtain the operator input 150 to disengage the clutch 140 based on causing the notification to be displayed. The controller 130 performing the action to cause the clutch 140 to disengage may be based on obtaining the operator input 150. Alternatively, the controller 130 may perform the action automatically (e.g., without operator input) based on detecting that the clutch 140 is experiencing slippage.

The action may include providing a signal (e.g., to the hydraulic system 142) to cause a hydraulic circuit to provide hydraulic fluid to the clutch 140 to cause the clutch to be disengaged. For example, the controller 130 may transmit a disengage command to the hydraulic system 142. The hydraulic system 142 may provide hydraulic fluid to the clutch 140 (e.g., the first clutch 140*a* or the second clutch 140*b*) to cause a component of the clutch 140 to disengage a mechanical connection, such that a mechanical connection between the power source 132 and a fluid pump 108 is disengaged. Detecting that a clutch 140 is slipping (e.g., as described herein) may enable the controller 130 to disengage the clutch 140 before serious or catastrophic failures occur. Moreover, because of the use of the clutches 140, other fluid pumps 108 of the dual-pump single-power source system 200 may remain running, thereby improving an efficiency and flow capacity of the dual-pump single-power source system 200.

As shown by reference number 154, the controller 130 may determine whether a disengaged clutch can be re-engaged (e.g., can be safely re-engaged). For example, the controller 130 may detect that a clutch (e.g., the first clutch 140*a* as an example) is in a disengaged position associated with disengaging the mechanical connection 136 between the first fluid pump 108*a* and the power source 132. The controller 130 may determine whether to permit the first clutch 140*a* to be actuated to an engaged position associated with engaging the mechanical connection 136 based on one or more conditions associated with the dual-pump single-power source system 200. For example, the one or more conditions may be based on a pressure load associated with the first fluid pump 108*a*, a speed associated with the power source 132, an input speed associated with the first clutch 140*a*, and/or an output speed associated with the first clutch 140*a*, among other examples.

For example, the controller 130 may obtain (e.g., via the pump controller 146*a*) one or more measurement values associated with the first fluid pump 108*a* via the pump status information. For example, the one or more measurement values may include the pressure load associated with the first fluid pump 108*a*, a discharge pressure associated with the first fluid pump 108*a*, and/or a rotational speed associated with the first fluid pump 108*a* (e.g., a rotational speed at an input of the first fluid pump 108*a* and/or a rotational speed of a crankshaft of the first fluid pump 108*a*), among other examples.

The controller 130 may determine whether to permit the first clutch 140*a* to be actuated to the engaged position based on determining whether a condition, of the one or more conditions, is met based on the pressure load associated with the first fluid pump 108*a* and a relative speed differential associated with the first clutch 140*a*. In other words, the controller 130 may determine whether it is safe to re-engage the first clutch 140*a* based on a current load situation of the first fluid pump 108*a* and a relative speed differential across the first clutch 140*a*. For example, the relative speed differential may be based on a difference between the input speed associated with the first clutch 140*a* and the output speed associated with the first clutch 140*a*. For example, the controller 130 may determine whether the relative speed differential associated with the first clutch 140*a* satisfies a re-engagement threshold. A value associated with the re-engagement threshold may be based on the pressure load associated with the first fluid pump 108*a*. In other words, when the first fluid pump 108*a* is associated with a higher pressure load (e.g., a higher discharge pressure), the re-engagement threshold may be associated with a lower value (e.g., the relative speed differential associated with the first clutch 140*a* may have a lower allowable value for re-engagement because of the higher pressure load of the first fluid pump 108*a*). When the first fluid pump 108*a* is associated with a lower pressure load (e.g., a low discharge pressure), the re-engagement threshold may be associated with a higher value (e.g., the relative speed differential associated with the first clutch 140*a* may have a higher allowable value for re-engagement because of the lower pressure load of the first fluid pump 108*a*).

As another example, the controller 130 may determine whether to permit the first clutch 140*a* to be actuated to the engaged position based on determining whether a condition, of the one or more conditions, is met based on the pressure load associated with the first fluid pump 108*a*, the speed associated with the power source 132 or a torque associated with the power source 132, and the output speed associated with the first clutch 140*a*. For example, the controller 130 may determine whether a difference between the speed associated with the power source 132 and the output speed associated with the first clutch 140*a* satisfies another re-engagement threshold. In a similar manner as described above, the other re-engagement threshold may be based on the pressure load associated with the first fluid pump 108*a*. In some examples, pressure or other relevant pumping information can be obtained from the fluid pump 108*b* or the second pump controller 146*b*.

The controller 130 may provide a signal (e.g., to the control panel 148) to cause a notification indicating whether the first clutch 140*a* is permitted to be actuated to the engaged position to be displayed by the control panel 148 associated with the dual-pump single-power source system 200. For example, the controller 130 may cause an annunciation lamp to be activated (e.g., to cause the lamp to turn on), indicating that it is not safe to re-engage the first clutch 140*a* based on determining that the first clutch 140*a* is not permitted to be actuated to the engaged position (e.g., based on the one or more conditions described above). Alternatively, the controller 130 may cause the annunciation lamp to be deactivated (e.g., to cause the lamp to turn off), indicating that it is safe to re-engage the first clutch 140*a* based on determining that the first clutch 140*a* is permitted to be actuated to the engaged position (e.g., based on the one or more conditions described above).

Additionally, or alternatively, the controller 130 may perform one or more actions to prevent the first clutch 140*a* from actuating to the engaged position based on determining that the first clutch 140*a* is not permitted to be actuated to the engaged position (e.g., based on the one or more conditions described above). For example, the controller 130 may obtain an operator input 150 indicating that the first clutch 140*a* is to be actuated to the engaged position. The control 130 may determine that the first clutch 140*a* is not permitted to be actuated to the engaged position (e.g., based on the one or more conditions described above). The controller 130 may refrain from providing instructions to cause the first clutch 140*a* to be actuated to the engaged position (e.g., the controller 130 may ignore the operator input 150). Alternatively, the controller 130 may perform an action to cause the first clutch 140*a* to be actuated to the engaged position to re-engage the first mechanical connection 136 based on the notification indicating that the first clutch 140*a* is permitted to be actuated to the engaged position (e.g., based on determining that the first clutch 140*a* is permitted to be actuated to the engaged position).

In some cases, the controller 130 may obtain a measurement value associated with a proximity sensor that is associated with the first clutch 140*a* (e.g., after performing an action to cause the first clutch 140 to be actuated to an engaged position). The controller 130 may determine whether the first clutch 140*a* has been successfully actuated to the engaged position based on the measurement value associated with the proximity sensor. For example, the measurement value associated with the proximity sensor may indicate whether components of the first clutch 140*a* are engaged, such as whether springs of the first clutch 140*a* are successfully inserted into grooves of the first clutch 140*a*. This may enable the controller 130 to detect whether a clutch 140 has successfully engaged a mechanical connection or coupling between the power source 132 and a fluid pump 108.

In some examples, as shown by reference number 156, the controller 130 may determine clutch adjustments for optimal combined pump performance for the dual-pump single-power source system 200. The clutch adjustments may be based on crank angles of the first fluid pump 108*a* and the second fluid pump 108*b*. For example, the controller 130 may obtain (e.g., via the first pump controller 146*a*) an indication of a first crank angle associated with the first fluid pump 108*a*. The controller 130 may obtain (e.g., via the second pump controller 146*b*) an indication of a second crank angle associated with the second fluid pump 108*b*. The controller 130 may determine that a difference between the first crank angle and the second crank angle is outside of a tolerance of an optimum crank angle difference value.

The crank angle difference value may be based on causing an alignment of a phase difference between the first fluid pump 108*a* and the second fluid pump 108*b* (e.g., an alignment of a first phase of the first fluid pump 108*a* with a second phase of the second fluid pump 108*b*) that optimizes a combined performance of the first fluid pump 108*a* and the second fluid pump 108*b*. For example, the first fluid pump 108*a* and/or the second fluid pump 108*b* may experience periodic fluctuations in discharge pressure (e.g., sometimes referred to as "pressure ripple"). The pressure ripple may be caused by flow oscillations from mechanics of the reciprocating pump. The mechanics of a fluid pump 108, as well as any pressure ripple, may cause a periodic increase or decrease in output torque as a drive shaft of the power source 132 rotates (e.g., sometimes referred to as "torque ripple"). By balancing phase differences between the first fluid pump 108*a* and the second fluid pump 108*b*, a performance of the dual-pump single-power source system 200 may be optimized because a negative effect of pressure ripple associated with the fluid pumps 108 may be reduced. For example, the phases of the first fluid pump 108*a* and the second fluid pump 108*b* may be aligned such that decreases in discharge flow of the first fluid pump 108*a* align (e.g., in time) with increases in discharge flow of the second fluid pump 108*b*. Similarly, the phases of the first fluid pump 108*a* and the second fluid pump 108*b* may be aligned such that decreases in discharge flow of the second fluid pump 108*b* align (e.g., in time) with increases in discharge flow of the first fluid pump 108*a*. In this way, a negative effect caused by pressure ripples of the fluid pumps 108 and/or a torque ripple of the power source 132 may be mitigated and a performance of the dual-pump single-power source system 200 may be optimized.

The crank angle difference value may be a value that causes the phases of the first fluid pump 108*a* and the second fluid pump 108*b* to be aligned in the optimized manner described above. For example, the crank angle difference value may be based on a quantity of cylinders 134 associated with the first fluid pump 108*a* and the second fluid pump 108*b*. For example, the quantity of cylinders 134 may be N (e.g., where the first fluid pump 108*a* includes N cylinders 134 and the second fluid pump 108*b* includes N cylinders 134). For example, the controller 130 may determine the crank angle difference value based on the quantity of cylinders 134 (e.g., N). For example, the crank angle difference value may be half of 360 degrees (e.g., one full phase or revolution) divided by the quantity of cylinders (e.g., N) associated with each respective fluid pump 108 of the dual-pump single-power source system 200. In other words, the crank angle difference value may be $$\frac{(N/360)}{2}.$$

For example, where N is equal to five, the crank angle difference value may be 36 degrees. As another example, where N is equal to three, the crank angle difference value may be 60 degrees.

The controller 130 may determine that a difference between the first crank angle (e.g., of the first fluid pump 108*a*) and the second crank angle (e.g., of the second fluid pump 108*b*) is outside of a tolerance of the crank angle difference value. The tolerance may be plus or minus Z degrees, where Z is a value greater than or equal to zero. For example, where N is equal to five, the crank angle difference is 36 degrees, and Z is five degrees, and the difference between the first crank angle (e.g., of the first fluid pump 108*a*) and the second crank angle (e.g., of the second fluid pump 108*b*) is 45 degrees, then the controller 130 may determine that the difference between the first crank angle and the second crank angle is outside of a tolerance of the crank angle difference value (e.g., 36 degrees plus and/or minus 5 degrees).

The controller 130 may determine that the crank angle of one of the, or both, fluid pumps 108 is to be adjusted based on determining that the difference between the first crank angle and the second crank angle is outside of a tolerance of the crank angle difference value. The clutches 140 may enable crank angles of the first fluid pump 108*a* and/or the second fluid pump 108*b* to be adjusted while the dual-pump single-power source system 200 is operating (e.g., "on-the-fly" while the power source 132 is running). For example, by modulating a clutch 140 between an engaged position and a disengaged position, a crank angle of a fluid pump 108 associated with the clutch 140 may be changed (e.g., "on-the-fly" while the power source 132 is running). Modulating the clutch 140 between an engaged position and a disengaged position may include modulating a fluid pressure (e.g., a hydraulic fluid pressure) associated with the clutch 140.

For example, the controller 130 may modulate a fluid pressure (e.g., a hydraulic fluid pressure) associated with the clutch 140 to cause "micro-slips" of the clutch 140 until a desired crank angle is achieved. For example, modulating the fluid pressure associated with at least one of the first clutch or the second clutch includes performing incremental pressure adjustments to the fluid pressure to cause the difference between the first crank angle and the second crank angle to progress from an initial crank angle difference to the crank angle difference over a time period, monitoring a speed differential across the first clutch or the second clutch, and performing an action to increase the fluid pressure if the speed differential satisfies a threshold. For example, the controller is configured to determine a fluid pressure threshold associated with the first clutch based on a discharge pressure associated with the first pump, a speed of the power source, and a torque limit or a speed limit associated with the first clutch, and performing the action to cause the first clutch to modulate between engaging and disengaging the first mechanical connection while the power source is running includes incrementally modifying a fluid pressure associated with the first clutch to below the fluid pressure threshold, with periodic pulses to modify the fluid pressure to be above the fluid pressure threshold. For example, modulating the fluid pressure associated with the first clutch 140*a* may cause the first clutch 140*a* to engage or disengage the mechanical connection 136 between the first fluid pump 108 and the power source 132 to cause the first crank angle to change. The controller 130 may modulate a fluid pressure associated with at least one of the first clutch 140*a* or the second clutch 140*b* to cause the difference between the first crank angle and the second crank angle to be within the tolerance of the crank angle difference value. For example, modulating the fluid pressure associated with the first clutch 140a may cause the first crank angle associated with the first fluid pump 108*a* to change. Similarly, modulating the fluid pressure associated with the second clutch 140*b* may cause the second crank angle associated with the second fluid pump 108*b* to change.

In some examples, the controller 130 may automatically modulate the fluid pressure associated with the first clutch 140*a* and/or the second clutch 140*b*. Alternatively, the controller 130 may modulate the fluid pressure associated with the first clutch 140*a* and/or the second clutch 140*b* based on receiving an operator input 150. For example, the controller 130 may provide a control panel indication to cause a notification to be displayed via the control panel 148. The notification may include an indication of the first crank angle, the second crank angle, and/or that the difference between the first crank angle and the second crank angle is outside of the tolerance of the crank angle difference value. The controller 130 may obtain the operator input 150 to modulate the fluid pressure associated with at least one of the first clutch 140*a* or the second clutch 140*b* (e.g., based on causing the notification to be displayed via the control panel 148).

For example, the controller 130 may perform an action to cause the first clutch 140*a* to modulate between engaging and disengaging the first mechanical connection 136 while the power source 132 is running to cause the first crank angle to be modified to a modified crank angle, where a difference between the modified crank angle and the second crank angle is within the tolerance of the crank angle difference value. The action to cause the first clutch 140*a* to modulate between engaging and disengaging the first mechanical connection while the power source 132 is running may cause a phase difference between an input shaft of the first clutch 140*a* and an output shaft of the first clutch 140*a* to be modified. Modifying the phase difference between the input shaft and the output shaft may cause the first crank angle to be modified to the modified crank angle. The second clutch 140*b* may be modulated in a similar manner to cause the second crank angle (e.g., of the second fluid pump 108*b*) to be modified.

In some examples, the controller 130 may determine a limit associated with modulating a clutch 140 so as to not cause the clutch 140 to experience excessive and un-intended slippage (e.g., as described above), because unintended slippage may result in a failure associated with the clutch 140 and/or the dual-pump single-power source system 200. For example, the controller 130 may determine a fluid pressure threshold based on a discharge pressure associated with at least one of the first fluid pump 108*a* or the second fluid pump 108*b* and a torque limit associated with a clutch 140 that is to be modulated (e.g., from the first clutch 140*a* and the second clutch 140*b*). The controller 130 may modulate the fluid pressure such that the fluid pressure is less than or equal to the fluid pressure threshold. The fluid pressure threshold may be based on a discharge pressure associated with fluid pump 108 associated with the clutch 140 that is to be modulated and a pressure/torque information of the clutch 140 that is to be modulated. This may enable the controller 130 to modulate the clutch 140 up to a point (but not exceeding the point) at which the clutch 140 may begin to experience small and controlled amounts of slippage. As used herein, "small and/or controlled" slippage may refer to momentarily and/or periodically modifying a pressure of hydraulic fluid being provided to a clutch 140 to cause the fluid pressure to satisfy a fluid pressure threshold (e.g., to momentarily and/or periodically induce a controlled slippage of the clutch 140). This may enable the controller 130 to safely change the crank angle of a given fluid pump 108 using a clutch 140 without causing excessive and damaging slippage of the clutch 140.

The controller 130 may include various components, such as a bus, a processor, a memory, an input component, an output component, and/or a communication component. The bus may include one or more components that enable wired and/or wireless communication among the components of controller 130. The processor may include a central processing unit, a graphics processing unit, a microprocessor, a controller, a microcontroller, a digital signal processor, a field-programmable gate array, an application-specific integrated circuit, and/or another type of processing component. The processor is implemented in hardware, firmware, or a combination of hardware and software. The memory may include volatile and/or nonvolatile memory. For example, the memory may include random access memory (RAM), read only memory (ROM), a hard disk drive, and/or another type of memory (e.g., a flash memory, a magnetic memory, and/or an optical memory). The memory may include internal memory (e.g., RAM, ROM, or a hard disk drive) and/or removable memory (e.g., removable via a universal serial bus connection). The memory may be a non-transitory computer-readable medium. The memory stores information, instructions, and/or software (e.g., one or more software applications) related to the operation of the controller 130. In some implementations, the memory may include one or more memories that are coupled to one or more processors, such as via the bus.

An input component enables the controller 130 to receive input, such as operator input and/or sensed input. For example, the input component may include a touch screen, a keyboard, a keypad, a mouse, a button, a microphone, a switch, a sensor, a global positioning system sensor, an accelerometer, a gyroscope, and/or an actuator. The output component enables the controller 130 to provide output, such as via a display, a speaker, to the control panel, and/or a light-emitting diode. The communication component enables the controller 130 to communicate with other devices via a wired connection and/or a wireless connection. For example, the communication component may include a receiver, a transmitter, a transceiver, a modem, a network interface card, and/or an antenna.

The controller 130 may perform one or more operations or processes described herein. For example, a non-transitory computer-readable medium (e.g., memory) may store a set of instructions (e.g., one or more instructions or code) for execution by the processor. The processor may execute the set of instructions to perform one or more operations or processes described herein. In some implementations, execution of the set of instructions, by one or more processors, causes the one or more processors and/or the controller 130 to perform one or more operations or processes described herein. In some implementations, hardwired circuitry is used instead of or in combination with the instructions to perform one or more operations or processes described herein. Thus, implementations described herein are not limited to any specific combination of hardware circuitry and software.

As indicated above, FIG. 3 is provided as an example. Other examples may differ from what is described with regard to FIG. 3.

Figure 4:
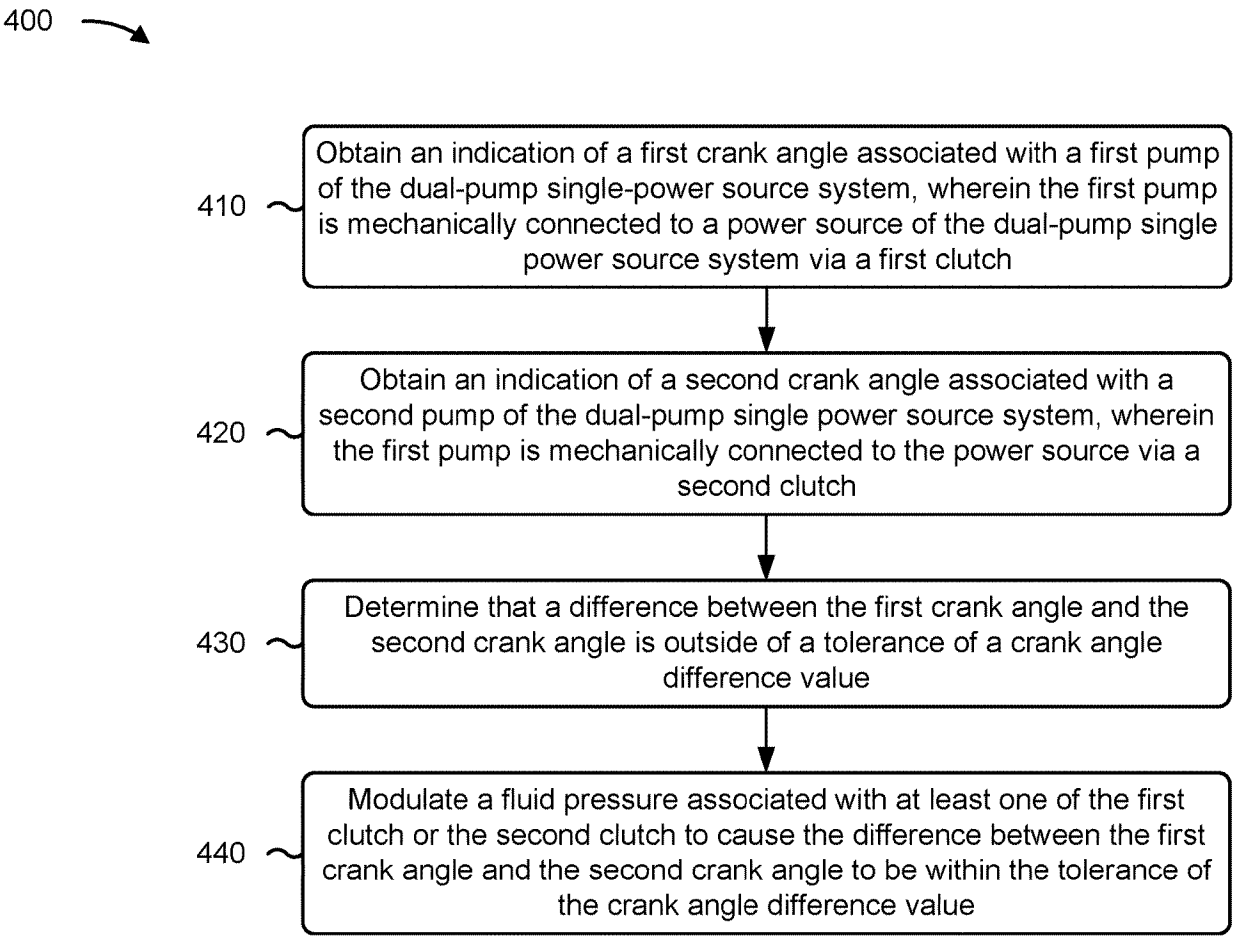
FIG. 4 is a flowchart of an example process associated with control of the dual-pump single-power source system.

FIG. 4 is a flowchart of an example process 400 associated with control of the dual-pump single-power source system 200. In some implementations, one or more process blocks of FIG. 4 may be performed by a controller (e.g., controller 130). In some implementations, one or more process blocks of FIG. 4 may be performed by another device or a group of devices separate from or including the controller, such as the clutch 140, the power source 132, a fluid pump 108, and/or a pump controller 146, among other examples. Additionally, or alternatively, one or more process blocks of FIG. 4 may be performed by one or more components of the controller 130, such as a processor, a memory, an input component, an output component, and/or a communication interface.

As shown in FIG. 4, process 400 may include obtaining an indication of a first crank angle associated with a first pump of the dual-pump single-power source system, wherein the first pump is mechanically connected to a power source of the dual-pump single-power source system via a first clutch (block 410). For example, the controller may obtain an indication of a first crank angle associated with a first pump of the dual-pump single-power source system, wherein the first pump is mechanically connected to a power source of the dual-pump single-power source system via a first clutch, as described above.

As further shown in FIG. 4, process 400 may include obtaining an indication of a second crank angle associated with a second pump of the dual-pump single-power source system, wherein the second pump is mechanically connected to the power source via a second clutch (block 420). For example, the controller may obtain an indication of a second crank angle associated with a second pump of the dual-pump single-power source system, wherein the second pump is mechanically connected to the power source via a second clutch, as described above.

As further shown in FIG. 4, process 400 may include determining that a difference between the first crank angle and the second crank angle is outside of a tolerance of a crank angle difference value (block 430). For example, the controller may determine that a difference between the first crank angle and the second crank angle is outside of a tolerance of a crank angle difference value, as described above. The crank angle difference value may be based on a quantity of cylinders associated with the first pump and the second pump. The crank angle difference value may be associated with an alignment of a first phase of the first pump with a second phase of the second pump.

As further shown in FIG. 4, process 400 may include modulating a fluid pressure associated with at least one of the first clutch or the second clutch to cause the difference between the first crank angle and the second crank angle to be within the tolerance of the crank angle difference value (block 440). For example, the controller may modulate a fluid pressure associated with at least one of the first clutch or the second clutch to cause the difference between the first crank angle and the second crank angle to be within the tolerance of the crank angle difference value, as described above. Modulating the fluid pressure associated with at least one of the first clutch or the second clutch may cause at least one of the first crank angle associated with the first pump to change or the second crank angle associated with the second pump to change. Modulating the fluid pressure associated with the first clutch may cause the first clutch to engage or disengage a mechanical connection between the first pump and the power source to cause the first crank angle to change.

Modulating the fluid pressure associated with at least one of the first clutch or the second clutch may include determining a fluid pressure threshold based on a discharge pressure associated with at least one of the first pump or the second pump and a torque limit associated with a clutch from the first clutch and the second clutch, and modulating the fluid pressure such that the fluid pressure is less than or equal to the fluid pressure threshold.

Process 400 may include providing a control panel indication to cause a notification to be displayed via a control panel, wherein the notification includes an indication of at least one of the first crank angle, the second crank angle, or that the difference between the first crank angle and the second crank angle is outside of the tolerance of the crank angle difference value, and obtaining an operator input to modulate the fluid pressure associated with at least one of the first clutch or the second clutch, wherein modulating the fluid pressure is based on obtaining the operator input.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

A hydraulic fracturing system may include one or more power sources for providing power to components (e.g., the pumps) of the hydraulic fracturing system. In some cases, a single power source (e.g., a single power source 132) may power or drive multiple pumps. For example, a single power source may power or drive two pumps of a hydraulic fracturing system. However, if the dual-pump single-power source system develops a problem (e.g., with a coupling between the power source and a pump, with a drive shaft of one of the pumps, and/or with a leak in one of the pumps, among other examples), the power source may be shut down to enable the problem to be addressed. In some cases, the problem may be with only a single pump of the system. However, because the single power source powers or drives multiple pumps, if an operator wants to stop one pump of a dual-pump single-power source system (e.g., for any reason), both pumps need to be stopped. This results in increased downtime for a larger flow capacity (e.g., due to the use of a dual-pump single-power source system, multiple pumps may be shut down when a problem occurs rather than only shutting down the pump associated with the problem). As a result, a pump that may otherwise be capable of running may have an increased downtime due to problems with another pump of the dual-pump single-power source system 200.

Some implementations described herein include one or more clutches 140 in the dual-pump single-power source system 200 to enable a fluid pump 108 to be shut down while the power source 132 is running and powering other fluid pumps 108 of the dual-pump single-power source system 200. For example, a clutch 140 enables a mechanical connection or coupling between the power source 132 and a fluid pump 108 to be disengaged. As a result, if there is a problem or failure associated with the fluid pump 108, with the coupling to the power source 132, and/or with the clutch 140, the mechanical connection with the power source 132 can be disengaged to prevent further problems or damage from occurring while also enabling the power source 132 to continue to power or drive other fluid pumps 108 of the dual-pump single-power source system 200.

Some implementations described herein enable early detection of slippage associated with a clutch 140. For example, by comparing a speed of the power source 132, an input speed to the clutch 140, and/or an output speed of the clutch 140, the controller 130 may be enabled to detect when slippage is occurring with the clutch 140. As another example, the controller 130 may compare phases or a phase differential of an output shaft of the power source 132, an input shaft to the clutch 140, and/or an output shaft of the clutch 140 for earlier detection of slippage associated with the clutch 140. This may enable the controller 130 to provide a notification to an operator to disengage the clutch 140, thereby reducing a likelihood of damage to the clutch 140 that would have otherwise been caused by the slippage.

Some implementations described herein enable the controller 130 to determine whether a clutch 140 can be re-engaged under certain conditions. For example, the controller 130 may compare a current load scenario associated with a fluid pump 108 that is associated with the clutch 140 (e.g., that is disengaged) and a relative speed differential across the clutch 140 to determine whether it is safe for the clutch 140 to be re-engaged. For example, the controller 130 may perform one or more actions to prevent the clutch 140 from being re-engaged if the controller 130 determines that it is not safe for the clutch 140 to be re-engaged. This may reduce a likelihood of damage to the clutch 140, to a driveline (e.g., a coupling or mechanical connection between the power source 132 and the fluid pump 108), and/or to the power source 132 that would have otherwise occurred if the clutch 140 were to be re-engaged under certain conditions.

Some implementations described herein enable optimized combined pump performance of the dual-pump single-power source system 200. For example, the clutches 140 may enable the controller 130 to finely tune or adjust crank angles of the fluid pumps 108 of the dual-pump single-power source system 200 (e.g., by safely inducing slippage in the clutches 140). This may enable the controller 130 to align phases of the multiple fluid pumps 108 to optimize a combined performance of the multiple fluid pumps 108. This may improve a flow capacity and an efficiency of the dual-pump single-power source system 200.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly. As used herein, satisfying a threshold may, depending on the context, refer to a value being greater than the threshold, greater than or equal to the threshold, less than the threshold, less than or equal to the threshold, equal to the threshold, not equal to the threshold, or the like.

What is claimed is:

1. A method of controlling a dual-pump single-power source system, comprising:

obtaining, by a controller, an indication of a first crank angle associated with a first pump of the dual-pump single-power source system during operation of the first pump to pressurize a fracturing fluid, wherein the first pump is mechanically connected to a power source of the dual-pump single-power source system via a first clutch;

obtaining, by the controller, an indication of a second crank angle associated with a second pump of the dual-pump single-power source system during operation of the second pump to pressurize the fracturing fluid, wherein the second pump is mechanically connected to the power source via a second clutch;

determining, by the controller, that a difference between the first crank angle and the second crank angle is outside of a tolerance of a crank angle difference value; and modulating, by the controller and during operation of the first pump and the second pump to pressurize the fracturing fluid, a fluid pressure associated with at least one of the first clutch or the second clutch to cause the difference between the first crank angle and the second crank angle to be within the tolerance of the crank angle difference value.

2. The method of claim 1, wherein modulating the fluid pressure associated with at least one of the first clutch or the second clutch causes at least one of the first crank angle associated with the first pump to change or the second crank angle associated with the second pump to change.

3. The method of claim 1, wherein the crank angle difference value is based on a quantity of cylinders associated with the first pump and the second pump.

4. The method of claim 1, wherein the crank angle difference value is associated with an alignment of a first phase of the first pump with a second phase of the second pump.

5. The method of claim 1, wherein modulating the fluid pressure associated with the first clutch causes the first clutch to engage, disengage, or partially disengage, a mechanical connection between the first pump and the power source to cause the first crank angle to change.

6. The method of claim 1, further comprising:

providing a control panel indication to cause a notification to be displayed via a control panel, wherein the notification includes an indication of at least one of the first crank angle, the second crank angle, or that the difference between the first crank angle and the second crank angle is outside of the tolerance of the crank angle difference value; and obtaining an operator input to modulate the fluid pressure associated with at least one of the first clutch or the second clutch, wherein modulating the fluid pressure is based on obtaining the operator input.

7. The method of claim 1, wherein modulating the fluid pressure associated with at least one of the first clutch or the second clutch comprises:

determining a fluid pressure threshold based on a discharge pressure associated with at least one of the first pump or the second pump and a torque limit associated with one of the first clutch and the second clutch; and modulating the fluid pressure such that the fluid pressure is less than or equal to the fluid pressure threshold.

8. The method of claim 1, wherein modulating the fluid pressure associated with at least one of the first clutch or the second clutch comprises:

performing incremental pressure adjustments to the fluid pressure to cause the difference between the first crank angle and the second crank angle to progress from an initial crank angle difference to the crank angle difference value over a time period;

monitoring a speed differential across the first clutch or the second clutch; and performing an action to increase the fluid pressure if the speed differential satisfies a threshold.

9. A controller for controlling a dual-pump single-power source system, comprising:

one or more memories; and one or more processors configured to:

obtain an indication of a first crank angle associated with a first pump of the dual-pump single-power source system during operation of the first pump to pressurize a fracturing fluid, wherein the first pump is mechanically connected to a power source of the dual-pump single-power source system via a first clutch;

obtain an indication of a second crank angle associated with a second pump of the dual-pump single-power source system during operation of the second pump to pressurize the fracturing fluid, wherein the second pump is mechanically connected to the power source via a second clutch; and perform an action to cause the first clutch to modulate, during operation of the first pump and the second pump to pressurize the fracturing fluid, between engaging and disengaging a mechanical connection with the power source to cause the first crank angle to be modified to a modified crank angle, wherein the first crank angle is modified such that a difference between the modified crank angle and the second crank angle is modified to be within a tolerance of a crank angle difference value.

10. The controller of claim 9, wherein the one or more processors are further configured to:

determine that a difference between the first crank angle and the second crank angle is outside of the tolerance of the crank angle difference value.

11. The controller of claim 9, wherein the crank angle difference value is half of 360 degrees divided by a quantity of cylinders associated with each respective pump of the dual-pump single-power source system.

12. The controller of claim 9, wherein the one or more processors are further configured to:

determine a fluid pressure threshold associated with the first clutch based on a discharge pressure associated with the first pump and a torque limit or a speed limit associated with the first clutch.

13. The controller of claim 12, wherein the one or more processors, to perform the action, are configured to:

modify a fluid pressure associated with the first clutch to cause the first clutch to modulate between engaging and disengaging the mechanical connection with the power source, wherein the fluid pressure satisfies the fluid pressure threshold.

14. The controller of claim 9, wherein the one or more processors, to perform the action, are configured to:

monitor a speed differential across the first clutch while causing the first crank angle to be modified to the modified crank angle; and cease the action to cause the first clutch to modulate between engaging and disengaging the mechanical connection with the power source based on the speed differential satisfying a threshold.

15. The controller of claim 9, wherein the crank angle difference value is associated with a difference between a first phase of the first pump and a second phase of the second pump.

16. A dual-pump single-power source system, comprising:

a power source;

a first pump connected to the power source via a first mechanical connection that includes a first clutch;

a second pump connected to the power source via a second mechanical connection that includes a second clutch; and a controller configured to:

obtain an indication of a first crank angle associated with the first pump during operation of the first pump to pressurize a fracturing fluid;

obtain an indication of a second crank angle associated with the second pump during operation of the second pump to pressurize the fracturing fluid;

determine that a difference between the first crank angle and the second crank angle is outside of a tolerance of a crank angle difference value;

perform an action to cause the first clutch to modulate, during operation of the first pump and the second pump to pressurize the fracturing fluid, between engaging and disengaging the first mechanical connection while the power source is running to cause the first crank angle to be modified to a modified crank angle, wherein a difference between the modified crank angle and the second crank angle is modified to be within the tolerance of the crank angle difference value.

17. The dual-pump single-power source system of claim 16, further comprising a control panel, and wherein the controller is further configured to:

provide a control panel indication to cause a notification to be displayed via the control panel, wherein the notification includes an indication of at least one of the first crank angle, the second crank angle, or that the difference between the first crank angle and the second crank angle is outside of the tolerance of the crank angle difference value; and obtain an operator input to modulate the first clutch, wherein performing the action is based on obtaining the operator input.

18. The dual-pump single-power source system of claim 16, wherein the action to cause the first clutch to modulate between engaging and disengaging the first mechanical connection while the power source is running causes a phase difference between an input shaft of the first clutch and an output shaft of the first clutch to be modified, and wherein modifying the phase difference between the input shaft and the output shaft causes the first crank angle to be modified to the modified crank angle.

19. The dual-pump single-power source system of claim 16, wherein the controller is further configured to:

determine a fluid pressure threshold associated with the first clutch based on a discharge pressure associated with the first pump, a speed of the power source, and a torque limit or a speed limit associated with the first clutch, and wherein performing the action to cause the first clutch to modulate between engaging and disengaging the first mechanical connection while the power source is running includes incrementally modifying a fluid pressure associated with the first clutch to below the fluid pressure threshold, with periodic pulses to modify the fluid pressure to be above the fluid pressure threshold.

20. The dual-pump single-power source system of claim 16, wherein the first clutch and the second clutch are shaft-mounted hydraulically actuated clutches.

* * * * *